United States Patent [19]

Cleveland et al.

[11] Patent Number: 4,589,993

[45] Date of Patent: May 20, 1986

[54] POWER TRANSMISSION SHIFT FLUIDS CONTAINING TWO-COMPONENT FRICTION MODIFIER ADDITIVE

[75] Inventors: William K. S. Cleveland, Roselle; Jack Ryer, East Brunswick; Harold E. Deen, Cranford, all of N.J.

[73] Assignee: Exxon Research & Engineering Co., Florham Park, N.J.

[21] Appl. No.: 672,420

[22] Filed: Nov. 16, 1984

Related U.S. Application Data

[63] Continuation of Ser. No. 453,121, Dec. 27, 1982, abandoned.

[51] Int. Cl.[4] ..... C10M 129/16; C10M 137/02; C10M 135/22

[52] U.S. Cl. ..... 252/78.5; 252/46.6; 252/48.6; 252/49.8; 252/75; 252/76; 252/79

[58] Field of Search ..... 252/46.6, 48.6, 49.8, 252/75, 76, 78.5, 79

[56] References Cited

U.S. PATENT DOCUMENTS

| | | | |
|---|---|---|---|
| 3,361,667 | 1/1968 | Wenborne et al. | 252/49.8 |
| 3,381,022 | 4/1968 | Le Suer | 252/56 D |
| 3,403,102 | 9/1968 | Le Suer | 252/49.8 |
| 3,446,739 | 5/1969 | Papay | 252/49.8 |
| 3,574,101 | 4/1971 | Murphy | 252/33.6 |
| 3,657,397 | 4/1972 | Brannen | 252/49.8 |
| 3,933,659 | 1/1976 | Lyle et al. | 252/75 |
| 4,344,853 | 8/1982 | Gutierrez et al. | 252/33.6 |

*Primary Examiner*—Paul Lieberman
*Assistant Examiner*—Robert A. Wax
*Attorney, Agent, or Firm*—J. J. Mahon; R. A. Maggio

[57] ABSTRACT

There are disclosed functional fluid compositions containing a two component friction modifier additive composed of a thio-bis-alkanol succinate ester and a phosphate diester such as dioleyl phosphite. The compositions are especially useful as tractor fluids.

7 Claims, No Drawings

POWER TRANSMISSION SHIFT FLUIDS CONTAINING TWO-COMPONENT FRICTION MODIFIER ADDITIVE

This is a continuation of application Ser. No. 453,121, filed Dec. 27, 1982, now abandoned.

The present invention relates to functional fluid compositions containing a two-component ester additive thereby providing to functional fluid or power transmitting oleaginous compositions, such as hydraulic fluids, automatic transmission fluids (ATF) useful friction modification properties.

More particularly, the invention relates to the use of mono- and di-esters of thio-bis alkanols and alkenyl succinic acid or anhydrides in combination with phosphite esters which are especially effective as friction modifier additives for tractor hydraulic fluids.

U.S. Pat. No. 4,344,853 discloses that the esters of thio-bis-alkanols are alkenyl succinic acid or anhydride do have useful friction properties. These are the same materials which form one component of the two-component system of the present invention.

In accordance with the present invention, there are provided mineral oil compositions useful as power transmission shift fluids containing a two-component additive in an amount effective to improve the friction characteristics of said composition, the first component being (i) a succinate mono- or di-ester, or mixture thereof, formed by the reaction of (a) thio-bis-alkanols of the formula:

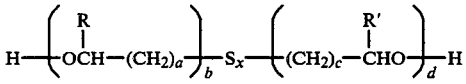

wherein R and R' each independently may be hydrogen, methyl or ethyl, x may be 1–4, a, b, c, and d each independently may be 1–3; with (b) 1 to 2 moles, per mole of the thio-bis-alkanol, of an aliphatic hydrocarbon-substituted succinic acid or anhydride or mixtures thereof wherein the aliphatic hydrocarbon group contains from 12 to 50 carbon atoms and the second component being (ii) a phosphite diester of the formula $$(R''O)_2P(:O)H$$

where R'' is an alkyl or alkenyl of 6 to 20 carbon atoms.

As used herein with respect to said first component, the term "monoester" or "hemiester" refers to product made from equimolar proportions of said thio-bis-alkanol and a succinic acid or anhydride, that is, one free hydroxyl group remains; while the term "di-ester" refers to those products wherein each hydroxyl group of the thio-bis-alkanol is esterified with a hydrocarbyl-substituted or polyolefin-substituted succinic acid or anhydride. In either case, a succinic acid moiety remains, i.e., a —C(O)OH group.

The relative amounts of the first and second components are such that the ratio in parts by weight of the succinate ester first component to phosphite diester second component is from about 2:1 to 1:2, preferably 1:1.

The hydrocarbyl-succinic acids or anhydrides for preparing the first component are per se known in the art and the commonly used anhydride may be represented by the formula:

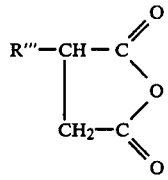

wherein R''' is a $C_{12}$–$C_{50}$ aliphatic hydrocarbon group, such as an alkyl, alkenyl, isoalkyl, isoalkenyl or cycloalkyl hydrocarbyl group. Oligomers containing 12 to 50 carbon atoms are also suitable as the aliphatic hydrocarbyl group, such as oligomers of $C_2$–$C_5$ monoolefins, such as isobutene.

The aliphatic hydrocarbyl group may be an unsubstituted hydrocarbon group or it may contain substituents such as chlorine, bromine, sulfur, phosphorous, nitrogen or oxygen which will not affect the utility of the final mono- or di-ester product. A preferred substituent is sulfur as exemplified by 2-octadecylthio succinic anhydride.

The thio-bis-alkanol useful in forming the succinate ester first component includes those ester-forming diol compounds of the formula:

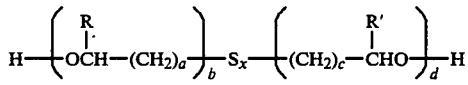

wherein R and R' each independently may be hydrogen, methyl or ethyl, x may be 1–4, a, b, c and d each independently may be 1–3. If b or d are greater than 1, then the formula is meant to express ethoxylated derivatives of such alcohols.

Preferred embodiments are those thio-bis-alkanols within the foregoing formula herein a, b, c and d are each 1 or 2 and R is H or $CH_3$. Specific compounds include 2,2'-dithiodiethanol 2,2'-thiodiethanol, di(2-hydroxypropyl)disulfide and 3,3'-thiodipropanol.

Formation of these mono and di-esters proceeds by reacting the appropriate quantities of anhydride (or acid) and thio-bis-alkanol with or without an inert organic solvent diluent and heating and stirring the mixture at about 50° to 150° C. until esterification of the anhydride is complete. Equimolar quantities of each reactant will provide mainly the mono- (or hemi-)ester and reaction of 2 moles of hydrocarbon substituted succinic acid or anhydride per mole of thio-bis-alkanol will provide the di-ester material. Also, products useful in the present invention encompass mixtures of such mono- and di-esters.

Insofar as yields are concerned, the reaction of an equimolar ratio of thio-bis-alkanol and hydrocarbon succinic anhydride will provide a product containing about 80% mono-ester and about 20% di-ester. The di-ester is produced in somewhat higher yields, about 90% of the product being di-ester and about 10% mono-ester when the mole ratio of succinic anhydride to thio-bis-alkanol is 2:1. The di-ester compounds exibit generally better friction properties.

In the case of a di-ester compound, it is suitable to use succinic anhydrides having less than $C_{12}$ hydrocarbon substituent so long as the total number of carbon atoms of the hydrocarbon substituents on the succinic moiety of the ester compounds is at least $C_{12}$ since oil solubility of the finished compound is the important property.

The second component of the friction modifier additive of the present invention is a phosphite diester of the formula $$(R''O)_2P(:O)H$$

where R may be an alkyl or alkenyl group having about 6 to 20 carbon atoms and preferably about 12 to 18 carbon atoms. Particularly preferred is dioleyl phosphite. These phosphite ester compounds are, per se, well known in the art, and may be prepared by conventional techniques. Examples of all other suitable phosphite diesters are distearyl phosphite, di-2-ethylhexyl phosphite, diclodecyl phosphite as well as phosphite diesters of mixed fatty alcohols, such as cetyl, stearyl and oleyl alcohols, or tallow alcohols ($C_{16}$–$C_{18}$ fatty alcohols).

The particularly preferred embodiment of the present invention is a two component system composed of about equal parts by weight of 2,2'-thiodiethylbis(octadecenylsuccinic acid ester) as the first component and dioleyl phosphite as the second component.

The two-component system of the present invention has been found to exhibit a synergistic effect upon friction characteristics compared with either component used separately at equivalent additive concentration levels. The additive system of this invention is especially useful in functional fluids such as tractor hydraulic fluids which use oil-immersed brakes and power takeoff clutches running in a common oil supply with the transmission. Frictional characteristics of the fluid are important to meet the demands of noiseless braking and power takeoff clutch capacity to provide effective frictional coupling of two or more unconnected surfaces that are immersed or in contact with the functional fluid.

The compositions of the present invention will contain the two-component additive in amounts effective to provide the desirable properties of friction modification of retention to the power transmitting fluid. Generally there will be present 0.05 to 2 wt% of the two component additive based on the total weight of the composition, preferably there is employed about 0.1 to 1.5 wt% of the two-component additive in the hydrocarbon mineral oil fluid, such as a tractor hydraulic fluid which is the preferred composition.

Power transmission shift fluids are those functional fluid compositions such as automatic transmission fluids, power steering and brake fluids, hydraulic fluids and such compositions contain a number of conventional additives providing their normal attendant functions and are typically blended into the mineral oil base in the following ranges:

| Components | Concentration Range (Vol. %) |
|---|---|
| V.I. Improver | 1–15 |
| Corrosion Inhibitor | 0.01–1 |
| Oxidation Inhibitor | 0.01–1 |
| Dispersant | 0.5–10 |
| Pour point Depressant | 0.01–1 |
| Demulsifier | 0.001–0.1 |
| Anti-Foaming Agents | 0.001–0.1 |
| Anti-Wear Agents | 0.001–1 |
| Seal Swellant | 0.1–5 |
| Friction Modifiers | 0.01–1 |
| Mineral Oil Base | Balance |

Typical base oils for hydraulic and other power transmission shift fluids include a wide variety of light hydrocarbon mineral oils, such as, naphthenic base, paraffin base and mixtures thereof, having a lubricating viscosity range of about 34 to 45 SUS (Saybolt Universal Seconds) at 38° C.

The invention is further illustrated by the following examples which are not to be considered as limitative of its scope. Hydraulic fluids used in the following examples were formulated in accordance with the components and concentrations noted above and are referred to as Base Fluid.

EXAMPLE

To samples of a Base Fluid useful as a tractor hydraulic fluid was added 1% by weight of friction modifier additives A, B and C listed below to provide three separate fluids:

Additive A: Dioleyl Phosphite

Additive B: 2,2'-thiodiethylbis(octadecenyl succinic acid ester)

Additive C: A mixture of 50% by weight A and 50% by weight B

The friction characteristics of the three fluids were evaluated using the SAE #2 friction machine which evaluates torque transfer and reports the value ΔS which is the change in torque in lb.ft. as a function of time. The results were:

| Fluid | ΔS |
|---|---|
| Additive A, 1 wt% | 9 |
| Additive B, 1 wt% | 12 |
| Additive C, 1 wt% | 6 |

Lower values for ΔS in this test, i.e. less than about 10, indicate improvement in frictional properties; the two-component system of the invention exhibits a synergistic effect when compared with the same components used separately at the same 1 wt% concentration level in the same Base Fluid.

What is claimed is:

1. A power transmission shift fluid composition comprising a mineral oil base containing a two-component additive in an amount effective to improve the friction characteristics of the fluid composition, the first component being (i) a succinate ester formed by the reaction of:

(a) a thio bis-alkanol of the formula:

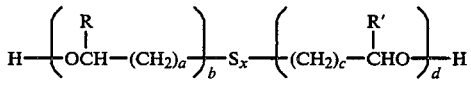

wherein R and R' each independently may be hydrogen, methyl or ethyl, x may be 1–4, and a, b, c, d, each may be independently 1–3, with (b) 1 to 2 moles, per mole of the thio-bis-alkanol, or an aliphatic hydrocarbon-substituted succinic acid or anhydride wherein the aliphatic hydrocarbon group contains from 12 to 50 carbon atoms, and the second component being (ii) a phosphite diester of the formula $$(R''O)_2P(O)H$$

where R'' is an alkyl or alkenyl group of 6 to 20 carbon atoms.

2. The composition of claim 1 wherein there is present 0.05 to 2.0 weight percent of said two-component additive and the weight ratio of said first component to said second component is about 1:2 to 2:1.

3. A composition according to claim 1 wherein the first component is formed by the reaction of 1 mole of said hydrocarbon succinic acid or anhydride per mole of said thio-bis-alkanol.

4. A composition according to claim 1 wherein the first component is formed by the reaction of 2 moles of said hydrocarbon succinic acid or anhydride per mole of said thio-bis-alkanol.

5. A composition according to claim 1 wherein said R′ of said second component has 12 to 18 carbon atoms.

6. A composition according to claim 2 wherein said composition is a tractor fluid composition.

7. A composition according to claim 6 wherein said first component is 2,2′-thiodiethylbis(octadecenylsuccinic acid ester) and said second component is dioleyl phosphite.

* * * * *